US005098081A

United States Patent [19]

DeFigueiredo

[11] Patent Number: 5,098,081

[45] Date of Patent: Mar. 24, 1992

[54] SIDE GUIDES ADJUSTMENT MECHANISM

[75] Inventor: Carlos L. DeFigueiredo, Danbury, Conn.

[73] Assignee: Pitney Bowes Inc., Stamford, Conn.

[21] Appl. No.: 632,803

[22] Filed: Dec. 24, 1990

[51] Int. Cl.[5] ..... B65H 9/04

[52] U.S. Cl. ..... 271/240; 271/253; 271/254

[58] Field of Search ..... 271/253, 254, 255, 240, 271/238, 234, 241, 229, 226, 171, 144; 198/836.3; 222/198, 199

[56] References Cited

U.S. PATENT DOCUMENTS

| | | | |
|---|---|---|---|
| 1,823,042 | 9/1931 | Hartmann | 271/223 |
| 3,061,303 | 10/1962 | Glaser et al. | 271/240 X |
| 3,807,725 | 4/1974 | Bookless | 271/171 |
| 3,974,953 | 8/1976 | Klose | 271/240 X |
| 4,174,103 | 11/1979 | Back et al. | 271/171 |
| 4,418,515 | 12/1983 | Foster et al. | 53/457 |
| 4,607,834 | 8/1986 | Dastin | 271/171 |
| 4,685,793 | 8/1987 | Sawada et al. | 271/253 X |

FOREIGN PATENT DOCUMENTS

| | | | |
|---|---|---|---|
| 1436617 | 3/1969 | Fed. Rep. of Germany | 271/253 |
| 59-128147 | 7/1984 | Japan | 271/240 |
| 63-117823 | 8/1988 | Japan | 271/240 |

*Primary Examiner*—David H. Bollinger

*Attorney, Agent, or Firm*—Charles R. Malandra, Jr.; David E. Pitchenik; Melvin J. Scolnick

[57] ABSTRACT

In a machine for processing sheet material, an apparatus for centering and deskewing the sheet material being processed, comprises a deck; a pair of side guides adjustably located above the deck; adjustment limiting structure coupled to the side guides for limiting the distance adjustments can be made; linkage structure operatively coupled to the side guides and to the adjustment limiting structure for maintaining fixed center adjustments to the side guides, the linkage structure comprising at least three links, including a center link pivotally mounted to a center point of the deck and two end links, each of the end links coupled to one of the side guides; and friction structure coupled to each of the side guides for maintaining a position of the side guides after an adjustment is made.

15 Claims, 2 Drawing Sheets

SIDE GUIDES ADJUSTMENT MECHANISM

Field of the Invention

The present invention relates to apparatus for providing parallel side guides used in processing sheet material, and more particularly, to adjustable side guides for handling different sized paper sheets.

BACKGROUND OF THE INVENTION

In devices which feed and convey sheet material, such as inserter machines, it is well known to use side guides for centering and deskewing the sheets being fed or conveyed. It is also known to use adjustable side guides so that such devices can handle sheet material of various widths. The following examples of various known adjustable side guide mechanisms are provided.

In U.S. Pat. No. 3,061,303 issued to D. A. Glaser, et al. on Oct. 30, 1962, there is disclosed a self-centering parallel guide assembly, including two side guide members which remain parallel and equally spaced from a center line whenever adjustments are made. However, the linkage disclosed in Glaser causes the side guides to move longitudinally as well as laterally when the adjustment is made. Glaser, et al. is not suitable for use in devices which require that the side guides maintain their longitudinal positions because of space limitations or processing requirements.

U.S. Pat. No. 3,974,953, issued to Karl W. Klose on Aug. 17, 1976, discloses apparatus for an automatic self-centering feed conveyor. The Klose apparatus works only with material rigid enough to achieve the automatic self-centering feature. This apparatus is not suitable for use in a device processing non-rigid sheet material such as paper.

U.S. Pat. No. 4,418,515, issued to Foster, et al. on Dec. 6, 1983 and assigned to the assignee of the present invention, discloses a side guides adjustment mechanism for an inserter machine. The side guides are adjusted by rotation of a knob, which in turn drives a cam shaft causing cam followers associated with the respective side guides to rotate thereby resulting in lateral displacement of the side guides. Although this mechanism works well, it requires several moving parts which must be interconnected from the base area of the inserter machine to the side guides, thus requiring significant amount of space within the inserter machine for housing the adjustment mechanism.

SUMMARY OF THE INVENTION

It has been found that a side guides adjustment mechanism using a linkage system pivotally connected to a fixed center location in the deck and interconnecting the side guides provides self-centering side guides adjustments which do not change the longitudinal position of the side guides. It has further been found that such mechanism requires a significantly less number of parts than conventional rack and pinion mechanisms and cam following mechanisms. The side guides adjustment mechanism of the present invention has a smaller profile which requires less space for mounting than conventional side guides. The self-centering adjustment is made by directly positioning one of the side guides causing the other side guides automatically to be positioned. In the preferred embodiment of the present invention, spring tension on the side guides maintains the adjusted position.

In a machine for processing sheet material, an apparatus for centering and deskewing the sheet material being processed comprises a deck; a pair of side guides adjustably located above the deck; adjustment limiting means coupled to the side guides for limiting the distance adjustments can be made; linkage means operatively coupled to the side guides and to the adjustment limiting means for maintain fixed center adjustments to the side guides, the linkage means comprising at least three links, including a center link pivotally mounted to a center point of the deck and two end links, each of the end links coupled to one of the side guides; and friction means coupled to each of the side guides for maintaining a position of the side guides after an adjustment is made.

In one embodiment of the present invention, the adjustment limiting means includes two slide blocks and two slots in the deck, each of the slide blocks slidably engaging one of the slots and being coupled to one of the side guides. The friction means includes a spring tension means operatively coupled to each of the side guides. The spring tension means includes a pair of springs located under the deck. Each of the springs is coupled to one of the side guides by a stud passing through the deck, the spring exerting a force pushing against the stud whereby the side guide is pulled against the deck.

BRIEF DESCRIPTION OF THE DRAWINGS

Further features and advantages of the apparatus in accordance with the invention will be clearly seen and more easily understood from the description of the figures wherein.

DETAILED DESCRIPTION OF THE PREFERRED EMBODIMENT

Figure 1:
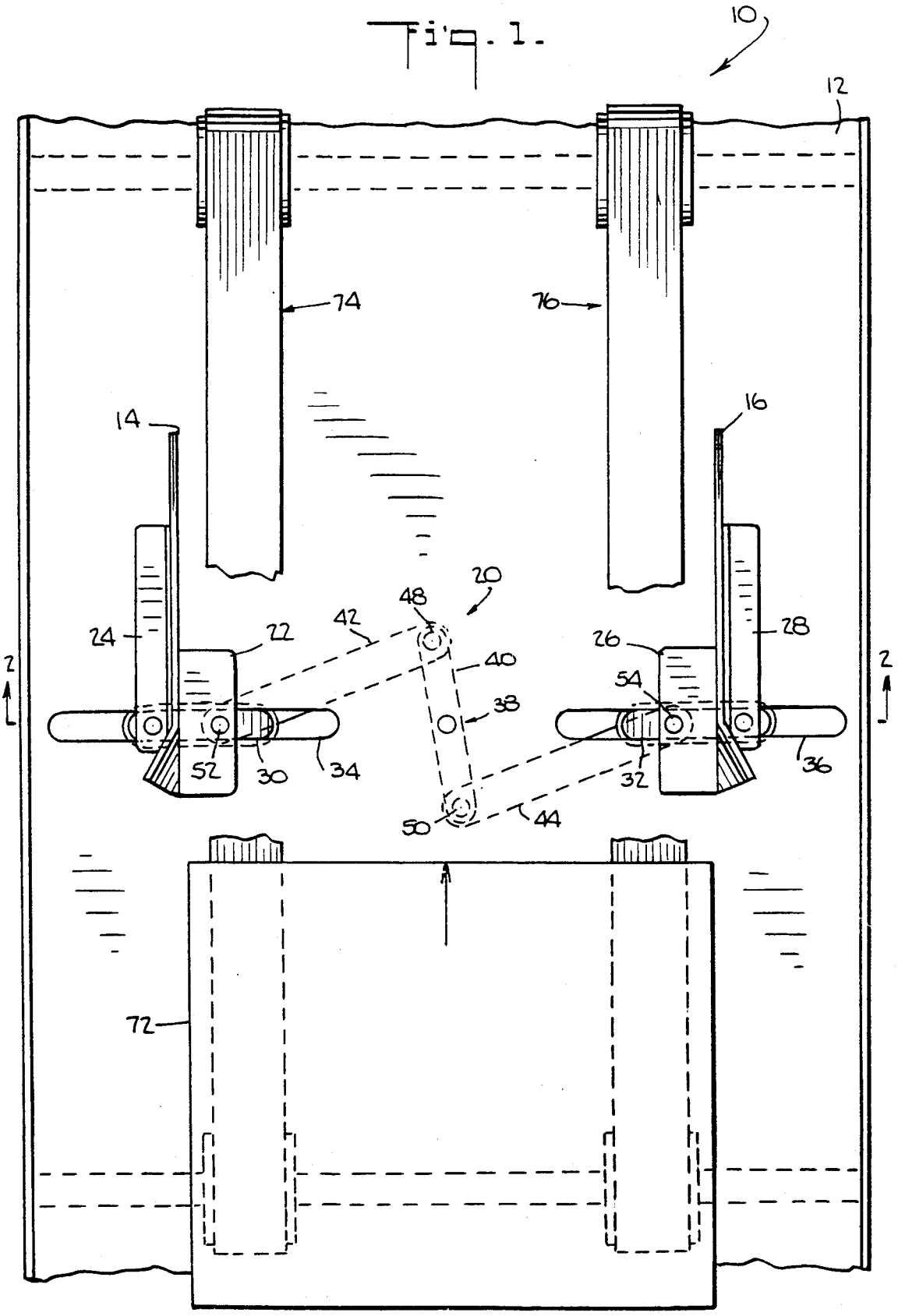
FIG. 1 is a plan view of a deck including an adjustable side guides mechanism in accordance with the present invention.
Figure 2:
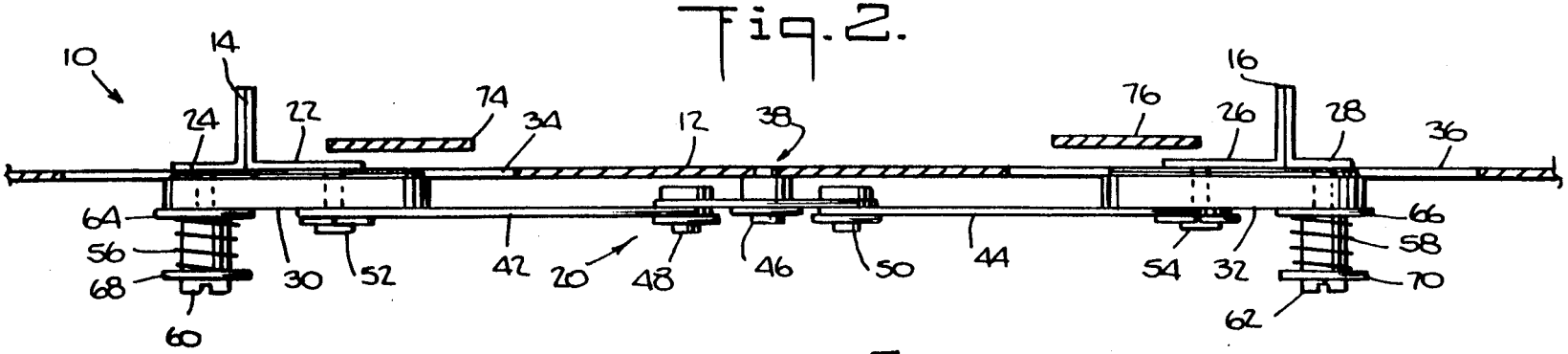
FIG. 2 is an end view of the deck shown in FIG. 1 taken on the line 2—2.

Referring now in detail to the drawings, there is shown a transport deck generally designated 10, which is constructed in accordance with and embodies the present invention. Transport deck 10 comprises deck plate 12, side guides 14 and 16 located above deck plate 12, and linkage system 20 located below deck plate 12. In the preferred embodiment of the present invention, side guides 14 and 16 include inner support members 22 and 26 respectively and outer support members 24 and 28 respectively. There are two laterally extended slots 34 and 36 located at opposite sides in deck plate 12. Side guides 14 and 16 are coupled to slide blocks 30 and 32, respectively, as described below. Adjustments to side guides 14 and 16 are tracked by slide blocks 30 and 32 which extend in part into slots 34 and 36, respectively. Slide blocks 30 and 32 each comprise an upper and lower portion. The lower portion of slide blocks 30 and 32, shown in FIGS. 1 and 3 by broken lines designated 31 and 33, are situated against the underside of deck plate 12. The upper portions of slide blocks 30 and 32 have an indentation or step around the top perimeter which is suitable for the upper portion of slide blocks 30 and 32 to extend into slots 34 and 36, respectively. The height of the indentation must be less than the thickness of deck plate 12 so that a gap remains between side guides 14 and 16 and side blocks 30 and 32 allowing a spring tension load on side guides 14 and 16 as described below. In operation, the adjustments to the position of the side guides are tracked and limited by the movement of the upper portion of slide blocks 30 and 32 in slots 34 and 36.

Linkage system 20 comprises a center link 40 and two side links 42 and 44. Linkage system 20 is suspended below deck plate 12 a fixed distance corresponding to the height of the non-recessed or lower portion of slide blocks 30 and 32, i.e., the portion extending below deck plate 12. Center link 40 is pivotally affixed to a location along the center line 38 of deck plate 12. In the preferred embodiment of the present invention, a pivot stud 46 is used to mount center link 40 whereby link 40 is free to pivot about a center location 38 on deck plate 12.

Each end of center link 40 is pivotally connected to an end of links 42 and 44 by pivot studs 48 and 50, respectively. The other ends of links 42 and 44 are pivotally mounted to the underside of slide blocks 30 and 32, respectively. Slide block 30 is coupled to inner support member 22 and link 42 by pivot stud 52. Slide block 32 is coupled to inner support member 24 and link 44 by pivot stud 54.

Slide blocks 30 and 32 are coupled to outer support members 24 and 28 and tension springs 56 and 58 by studs 60 and 62. There are washers 64 and 66 located between springs 56 and 58 and slide blocks 30 and 32 respectively. The spring tension on studs 64 and 66 is maintained by E-clips 68 and 70. As previously described, there is a gap between side guides 14 and 16 and slide blocks 30 and 32. In operation, springs 56 and 58 push E-clips 68 and 70 and studs 60 and 62 away from slide blocks 30 and 32 respectively. In this manner, studs 60 and 62 put a friction load on side guides 14 and 16, respectively, against deck 12 which maintains side guides 14 and 16 in a fixed position during normal operation. In the preferred embodiment of the present invention, side guide load is 2.5 pounds from each spring.

It will be understood by those skilled in the art that the present invention is suitable for use in centering sheet material such as enclosures or envelopes in an inserter machine. The present invention is particularly suitable for use on a table top inserter such as described in detail in U.S. Pat. No. 4,942,535 issued to Robert Francisco on July 17, 1990 and assigned to the assignee of the present invention. However, the present invention is suitable for use on any apparatus requiring the centering of sheet material being processed.

A means is provided for conveying the sheet material to the side guide are of the machine. In the preferred embodiment of the present invention, conventional belt and pulley arrangements 60 and 62 are used to convey sheets 64. It will be appreciated by those skilled in the art that other known means for conveying sheets can be used.

The present invention is suitable for centering the position of the sheets while the sheets are moving or stationary. In the preferred embodiment of the present invention, sheets 72 are stopped by a pair of pinch rollers (not shown) associated with the belt and pulley arrangements 74 and 76, and are then conveyed by the belt and pulley arrangements 74 and 76 for further processing. The belts are situated above deck 12 so that inner support members 22 and 26 fit under the belts when adjustments are made for narrow width sheets.

Figure 3:
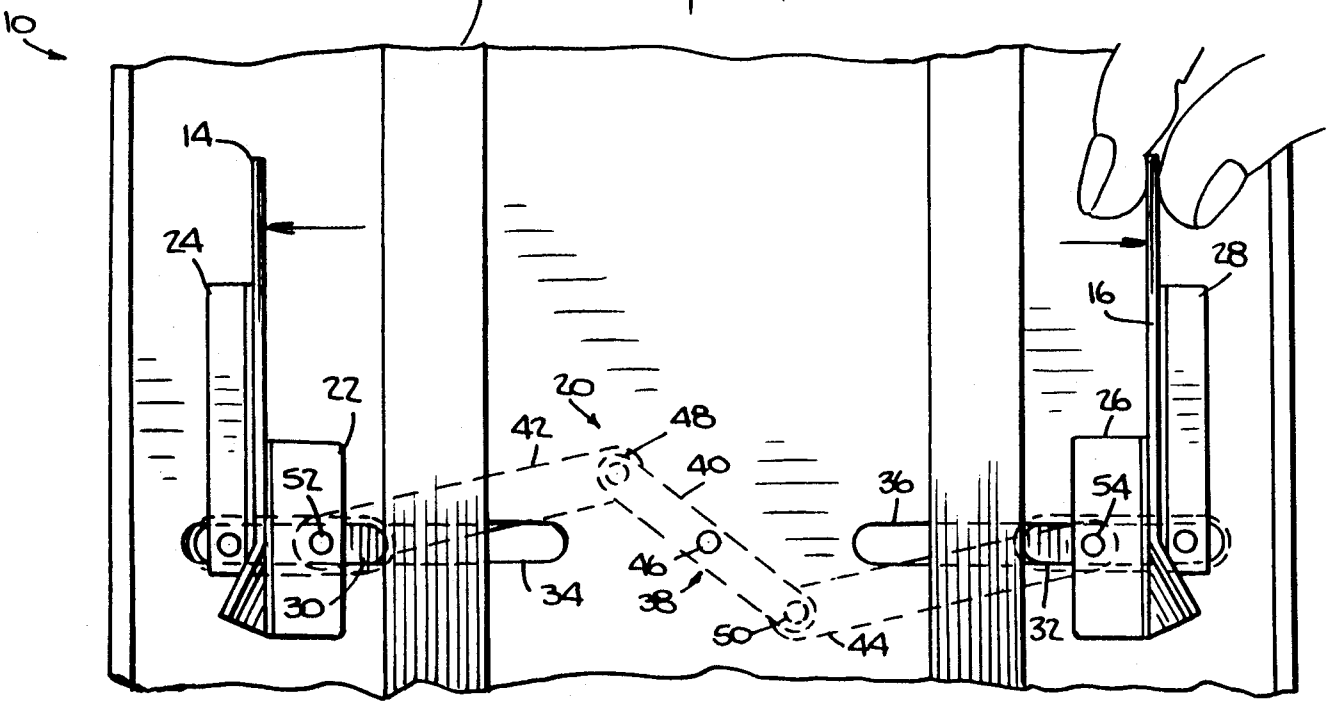
FIG. 3 is a plan view of the deck in FIG. 1 with the side guides adjusted.

In operation, side guides 14 and 16 are adjusted inwardly or outwardly by holding one of the side guides and moving the side guide a desired distance. For example, as seen in FIG. 3, when side guide 16 is moved outwardly, slide block 32 slides outwardly in slot 36 causing link 44 to pivot about stud 54 in a clockwise direction. This causes link 40 to pivot about stud 46 in a counter clockwise direction, which in turn causes link 42 to pivot about stud 52 in a clockwise direction. This outward movement of side guide 16 by fixed distance causes linkage system 20 to extend approaching a straight line arrangement centered about stud 46 whereby side guide 14 also moves outwardly the same fixed distance.

It will be understood by those skilled in the art, that any inward adjustment of side guide 16 by a fixed distance will cause links 40, 42 and 44 to pivot in the direction opposite that for outward movement of the side guide. This causes linkage system 20 to shorten in length whereby side guide 14 also moves inward by the same fixed distance.

It has been found that the load on side guide 14 and 16 described previously is suitable for allowing the manual adjustment to the side guides and also provides adequate friction between side guides 14 and 16 and deck plate 12 for maintaining the adjusted position during the processing of the sheet material. It will be understood that certain sheet material may require a greater load to maintain the adjusted position.

It will be appreciated by those skilled in the art that there has now been described a novel apparatus for providing simple side guides adjustment. Now this invention has been described in conjunction with specific embodiments thereof, many alternatives, modifications and variations will be apparent to those skilled in the art. Accordingly, it is intended to embrace all such alternatives, modifications and variations that follow within the spirit and scope of the appended claims.

What is claimed is:

1. In a machine for processing sheet material, an apparatus for centering and deskewing the sheet material being processed, comprising:

a deck;

a pair of side guides adjustably located above the deck;

adjustment limiting means coupled to said side guides for limiting the distance adjustments can be made;

linkage means operatively coupled to said side guides and to said adjustment limiting means for maintaining fixed center adjustments to said side guides, said linkage means comprising at least three links, including a center link pivotally mounted to a center point of the deck and two end links, each of said end links coupled to one of said side guides; and friction means coupled to each of said side guides for maintaining a position of the side guides after an adjustment is made.

2. The apparatus according to claim 1, wherein the adjustment limiting means includes at least one slide block coupled to one of said side guides through a slot in said deck, said side block having an indented portion for slidably engaging said slot in said deck.

3. The apparatus according to claim 1, wherein the adjustment limiting means includes two slide blocks and two slots in said deck, each of said slide blocks slidably engaging one of said slots and being coupled to one of said side guides.

4. The apparatus according to claim 1 wherein said friction means includes a spring tension means operatively coupled to each of said side guides whereby said spring tension means pulls said side guides against said deck.

5. The apparatus according to claim 4 wherein said spring tension means includes a pair of springs located under said deck, each of said springs coupled to one of said side guides by a stud passing through said deck, said spring exerting a force pushing against said stud whereby said side guide is pulled against said deck.

6. The apparatus according to claim 1 wherein each of said side guides is comprised of an inner and outer support member, said inner member being coupled to said linkage means and said outer member being coupled to said friction means.

7. In a machine for processing sheet material, the machine including a deck over which the sheet material is conveyed and further including side guides for centering and deskewing the sheet material, the side guides including an adjustment mechanism for handling different sized sheet material, an improvement in the adjustment mechanism, said improvement comprising, adjustment limiting means coupled to the side guides for limiting the amount of the adjustment;

linkage means operatively connected to the side guides and to said adjustment limiting means for maintaining fixed center adjustments to said side guides, said linkage means comprising at least three links, including a center link pivotally mounted to a center point of the deck and two end links, each of said end links coupled to one of said side guides; and, friction means coupled to each of said side guides for maintaining a position of the side guides after an adjustment is made.

8. The improvement according to claim 7, wherein the adjustment limiting means includes at least one slide block coupled to one of said side guides through a slot in said deck, said side block having an indented portion for slidably engaging said slot in said deck.

9. The improvement according to claim 7, wherein the adjustment limiting means includes two slide blocks and two slots in said deck, each of said slide blocks slidably engaging one of said slots and coupled to one of said side guides.

10. The improvement according to claim 7 wherein said friction means includes a spring tension means operatively coupled to each of said side guides whereby said spring tension means pulls said side guides against said deck.

11. The improvement according to claim 10 wherein said spring tension means includes a pair of springs located under said deck, each spring coupled to one of said side guides by a stud passing through said deck, said spring exerting force pushing against said stud whereby said side guides is pulled against said deck.

12. The improvement according to claim 7 wherein each of said side guides is comprised of an inner and outer support member. said inner member being coupled to said linkage means and said outer member being coupled to said friction means.

13. In a inserter machine, an apparatus for centering and deskewing sheet material, comprising:

a deck;

a pair of side guides, each of said side guides located over one of two slots in said deck;

a pair of slide blocks, each of said slide blocks positioned below one of said slots and slidably extended in part into one of said slots, each of said slide blocks coupled to one of said side guides;

linkage means operatively coupled to said side guides for maintaining fixed center adjustments to said side guides, said linkage means comprising at least three links, including a center link pivotally mounted to a center point of said deck and two end links, each of said end links connected to one of said slide blocks;

spring tension means for maintaining an adjusted position of said side guides, said spring tension means including a pair of springs located under said deck, each of said springs coupled to one of said side guides by a stud passing from said side guide through a corresponding one of said slots, slide blocks and springs, said spring being mounted on said stud by a clip, wherein there is a gap between said side guide and said slide block so that said spring pushes against said stud forcing said side guide against said deck.

14. A method for making self-centering adjustments to a pair of side guides in a sheet material processing apparatus, a) coupling each side guide to adjustment limiting means, said limiting means being situated in the deck and including a separate section for each of said side guides;

b) providing a linkage means, said linkage means including at least three links with a center link pivotally mounted to a center point in the deck;

c) coupling each section of said limiting means to an end link of said linkage system;

d) moving one side guide a fixed distance resulting in said linkage system moving the other side guide the same distance in the opposite direction.

15. The method in claim 14 comprising the further step of:

e) providing friction means for maintaining the side guides in the adjusted position.

* * * * *